United States Patent [19]

Sherock

[11] 4,102,358

[45] Jul. 25, 1978

[54] PIPE THAWING DEVICE

[76] Inventor: Duane Sherock, P.O. Box 131, Plymouth, Mich. 48170

[21] Appl. No.: 822,673

[22] Filed: Aug. 8, 1977

[51] Int. Cl.[2] ..... E03B 7/14; F16L 53/00

[52] U.S. Cl. ..... 138/35

[58] Field of Search ..... 138/32, 35

[56] References Cited

U.S. PATENT DOCUMENTS

| | | | |
|---|---|---|---|
| 604,264 | 5/1898 | Phillips | 138/35 X |
| 1,120,837 | 12/1914 | Miller | 138/32 X |
| 2,172,082 | 9/1939 | Griffiths | 138/35 |

*Primary Examiner*—Harry N. Haroian

[57] ABSTRACT

A portable, compartmented receptacle, having an air pressure compartment and a vacuum compartment. Pump means to create pressure in said air compartment and means to heat the air on said air compartment. Pump means to create a vacuum in said vacuum compartment. A fitting communicating the interior of a frozen pipe with the interiors of said air compartment and said vacuum compartment and valves in the lines of communication to control the air pressure and vacuum and means to drain said vacuum compartment.

6 Claims, 3 Drawing Figures

PIPE THAWING DEVICE

In frigid areas of the country, frozen water pipes are the source of great material damage and mental frustration. Many devices have heretofore been shown to the public for overcoming the problem, but all such devices fall short of accomplishing the ends intended of them.

As early as 1891, the problem was present and U.S. Pat. No. 458,503 was disclosed means for using steam and hot water to thaw a pipe. This reference device employs air under pressure to aid combustion but the air is not the vehicle for carrying heat to the interior of the pipe. This reference device has many parts and is very complicated and of doubtful value. The prior art shows many different devices for thawing pipes but all leave much to be desired.

An object of this invention is to provide a simple, portable device with few working parts which can thaw a pipe in a minimum of time.

Another object of the invention is to employ heated air under pressure and vacuum as the direct vehicle for thawing the pipe and carrying off the residue.

Another object of the invention is to provide a device of the character indicated, which is compact and easily transported from place to place and is economical to manufacture and employ and is efficient in operation.

The foregoing and other objects and advantages of the invention will become more apparent as the description proceeds, reference being made from time to time to the accompanying drawings forming part of the within disclosure in which.

Figure 1:
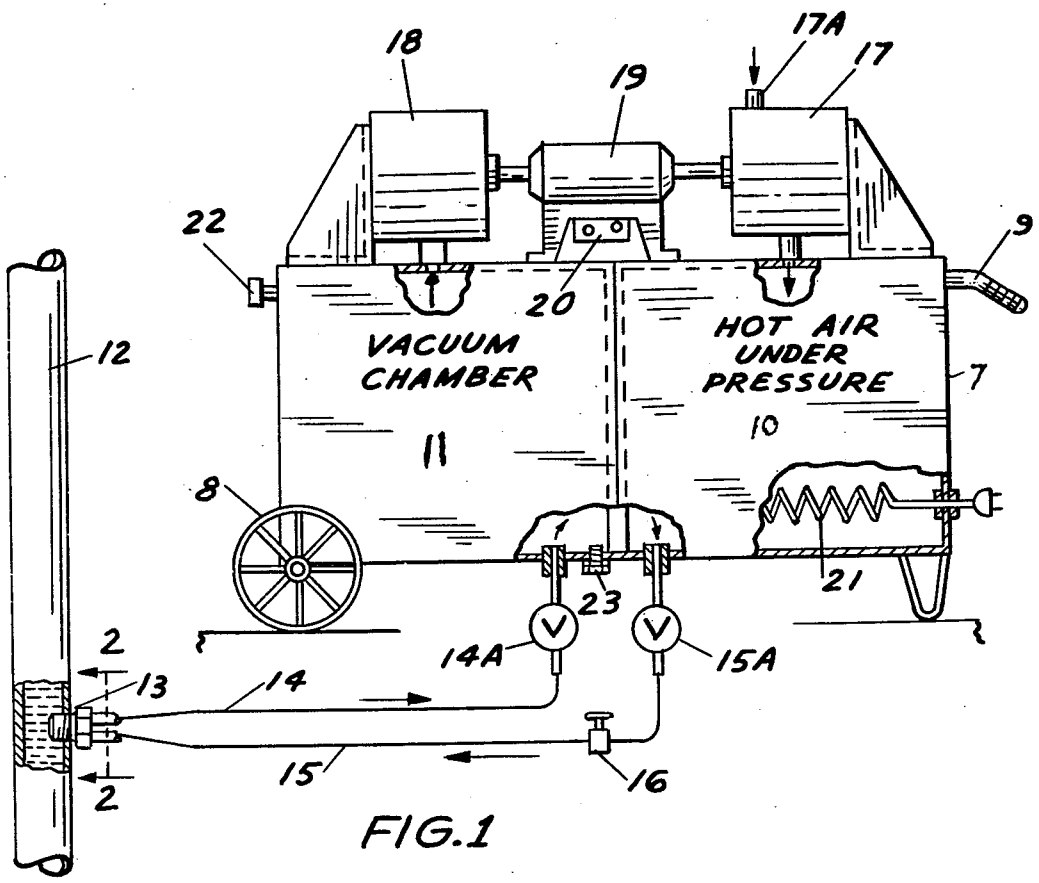
FIG. 1 is a side elevational view of a device with parts broken away and parts in section, showing the preferred form of my invention.
Figure 2:
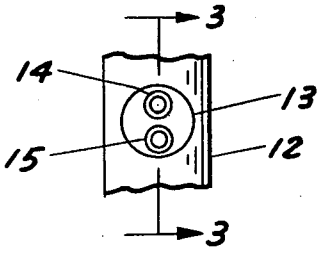
FIG. 2 is a section taken on line 2—2 of FIG. 1.
Figure 3:
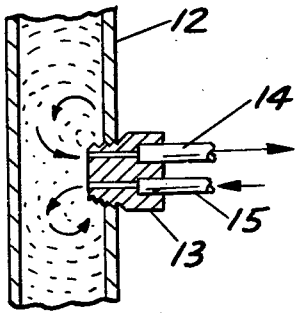
FIG. 3 is an enlarged section taken on line 3—3 of FIG. 2.

Referring now more particularly to the drawings, it will be understood that the reference character 7 indicates a receptacle which is made of heavy gauge metal and is provided with wheels 8 and handle 9 so that it may be easily transported from place to place. The receptacle 7 has an air compartment 10 and a vacuum compartment 11. Each of these compartments 10 and 11 communicate with the interior of the frozen pipe 12, through a fitting 13, which is threaded or otherwise secured to the pipe 12, and lines 14 and 15. Each line 14–15 is provided with a check valve 14A and 15A and the line 15 is also provided with a pressure control valve 16. The check valves 14A and 15A permit the flow only in the direction shown by the arrows in FIG. 1.

An air pump 17 supplies air to the chamber 10 and a vacuum pump 18 supplies vacuum to the chamber 11. Both pumps may be driven by a single motor 19, or separate motors may be used if desired. The motor 19 has an on-off switch 20. Air in the compartment 10 is heated by a coil 21 or other suitable means. The vacuum chamber 11 is provided with an outlet valves 22 and 23 so that water and the residue of the thawing operation may be discharged from the compartment 11.

In operation, the device works as follows: The motor 19 is turned on causing the pump 17 to pull air through the opening 17A and force it into the compartment 10 where it is heated by the coil 21. At the same time, the vacuum pump 18 pulls a vacuum in the chamber 11. When the heated air reaches the desired pressure, it circulates through the line 15 through the fitting 13 and into the pipe 12 where it starts to thaw the ice. At the same time, the vacuum created in the chamber 11 pulls the thawed water into the line 14 and into the chamber 11, where it can be disposed of through the drain 23 when the pressures in both chambers 10 and 11 become equalized. The operation continues until the ice in the pipe 12 is thawed sufficiently to permit regular flow again.

Having described my invention, what I claim and desire to secure by Letters Patent is:

1. In a device of the character described, in combination, a receptacle having a pressure compartment and a vacuum compartment, means to put pressure on said pressure compartment and pull a vacuum on said vacuum compartment, a fitting secured to a frozen pipe, lines communicating the interior of said pipe with the interior of said pressure and said vacuum compartments, means to heat the air in said pressure compartment and control means in said lines to regulate the flow of hot air from said pressure compartment through said fitting and back into said vacuum compartment.

2. The structure of claim 1, in which said last named means include check valves.

3. The structure of claim 1, in which said vacuum compartment has means for exhausting water or other thawing residue from said compartment.

4. The structure of claim 1, including a pressure pump and a vacuum pump and motor means for driving said pumps.

5. The structure of claim 1, including portable means for supporting said receptacle.

6. The structure of claim 4, in which said pumps and motor means are supported on the exterior of said receptacle.

* * * * *